United States Patent [19]

Iwasaki

[11] Patent Number: 4,480,238

[45] Date of Patent: Oct. 30, 1984

[54] YIG TUNED FILTER HAVING COUPLING LOOPS FORMED FROM CONDUCTIVELY LAYERED INSULATED PLATES

[75] Inventor: Jun-ichi Iwasaki, Kumagaya, Japan

[73] Assignee: Takeda Riken Co. Ltd., Tokyo, Japan

[21] Appl. No.: 434,320

[22] Filed: Oct. 14, 1982

Related U.S. Application Data

[63] Continuation-in-part of Ser. No. 419,921, Sep. 20, 1982, abandoned.

[30] Foreign Application Priority Data

Sep. 18, 1981 [JP] Japan ..... 56-139731

[51] Int. Cl.[3] ..... H01P 1/218

[52] U.S. Cl. ..... 333/202; 333/245; 333/219

[58] Field of Search ..... 333/202, 219, 212, 205, 333/207, 208, 204, 230, 24.1; 361/397, 399, 407, 412, 392; 339/17 LC, 18 B, 19

[56] References Cited

U.S. PATENT DOCUMENTS

| | | | |
|---|---|---|---|
| 2,297,488 | 9/1942 | Luderitz | 361/424 |
| 3,973,204 | 8/1976 | Keiter | 455/197 |
| 4,334,201 | 6/1982 | Shores | 333/202 |

*Primary Examiner*—Paul L. Gensler
*Assistant Examiner*—Benny Lee
*Attorney, Agent, or Firm*—Staas & Halsey

[57] ABSTRACT

A tunable YIG band pass filter which can be manufactured with reliably constant characteristics. A housing with slots for receiving insulating plates having a conducting layer on the side edge, and holes for receiving YIG elements over which indentations in the side edges having the conducting layers are located, provides the coupling loops of the filter to the YIG elements. The insulating plates and the YIG elements are fixed at predetermined positions.

13 Claims, 8 Drawing Figures

YIG TUNED FILTER HAVING COUPLING LOOPS FORMED FROM CONDUCTIVELY LAYERED INSULATED PLATES

This application is a continuation-in-part of Ser. No. 419,921, filed Sept. 20, 1982, now abandoned.

BACKGROUND OF THE INVENTION

This invention relates to tunable microwave devices incorporating ferrimagnetic resonance materials such as yttrium-iron garnet (YIG), and more particularly to an electronically tunable YIG band pass filter having a structure for which is easy to acquire identical filter characteristics in the production of the devices with high reliability.

The use of ferrimagnetic devices such as the YIG as electronic tuning elements in microwave band pass filters is relatively well known in the art, for instance, as described in U.S. Pat. No. 3,973,204. FIG. 1 is a schematic view showing a basic circuit configuration employed in a YIG microwave band pass filter. In this illustration three YIG spheres 1*a*, 1*b*, 1*c* are included. Although only one YIG sphere is necessary to construct a band pass filter, a more selective filter may be achieved by using additional YIG spheres.

Coupling loops 2*a*, 2*b*, 2*c*, 2*d* are disposed around the YIG spheres 1*a*, 1*b*, 1*c* in semicircular form so that they magnetically couple the YIG spheres. Also the loops are positioned orthogonally to each other so that the loops are magnetically decoupled, but the loops are coupled to each other through the resonance of the common YIG spheres. Input signals in FIG. 1 are supplied to the coupling loop 2*a* and are coupled to the YIG sphere 1*a*, and through the resonance of the YIG sphere 1*a* the signals are coupled to the coupling loop 2*b*.

The signals on the coupling loop 2*b* are coupled in the same manner, through the resonance of the YIG sphere 1*b*, to the loop 2*c*, and the signals at the coupling loop 2*c* are provided at an output terminal through the resonance of the YIG sphere 1*c*.

The coupling loops 2*a*, 2*b*, 2*c*, 2*d* are disposed in grooves 4 provided in a housing 3 as illustrated in FIG. 2. The housing 3 is made of a non-magnetic material like copper or plastic that is metalized on the surface.

In the prior art, these coupling loops 2*a*, 2*b*, 2*c*, 2*d* are made of thin wire of about 0.1 to 0.2 mm in diameter, or of a small metal film of about 0.1 mm thick and 0.2 to 0.5 mm wide. Since the loops are small and flexible, it is difficult to dispose the loops exactly in the same position and in the same form.

Further these loops are susceptible to shock or vibration and there is a possibility of their being moved or deformed by this shock or vibration. Consequently, variations in filter characteristics arise and thus reliability is low. Also, there is some uncertainty in disposing the coupling loops 2*a* to 2*d* in the desired position in the grooves 4 when setting up the band pass filter.

Accordingly, there is variation in the filter characteristics such as insertion loss or passband, and it is difficult to produce band pass filters with identical properties.

SUMMARY OF THE INVENTION

It is an object of the present invention to provide a structure for an electronic tuning microwave band pass filter which is capable of providing small differences in the filter characteristics of the band pass filters produced by this invention. It is another object of the present invention to provide an electronic tuning microwave band pass filter which is capable of providing high reliability.

According to the present invention, a YIG band pass filter has insulating plates one side of which are cut in semicircular form and conduction layers are formed along the side edge to serve as coupling loops. The insulating plates are inserted into grooves in the housing.

Since the coupling loops are constructed of the conductive layers on the edges of the insulating plate, the loops are stable and not easily changed or deformed in shape by stress originating for instance from shock or vibration.

In addition, it is easier and more accurate to make semicircular forms than the forms of the prior art, because the form of the loops occurs by cutting and metalizing the insulating plates.

Further, the coupling loops according to the invention are easy to handle and easy to mount accurately in the same position in the housing of each YIG device, so that the same filter characteristics are acquired among the microwave band pass filters.

DETAILED DESCRIPTION OF THE PREFERRED EMBODIMENTS

Figure 1:
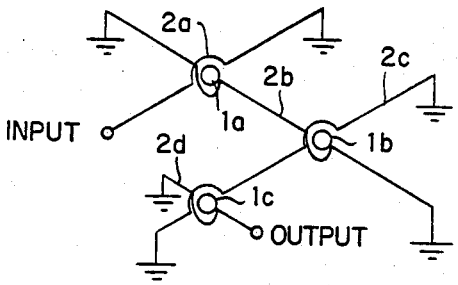
FIG. 1. (PRIOR ART)
FIG. 1 is a schematic diagram of a basic circuit configuration of the microwave band pass filter using three YIG spheres.
Figure 2:
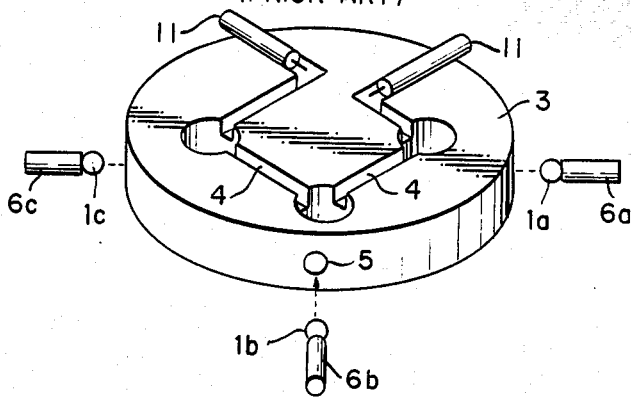
FIG. 2. (PRIOR ART)
FIG. 2 is a perspective view of the prior art YIG microwave band pass filter.
Figure 3:
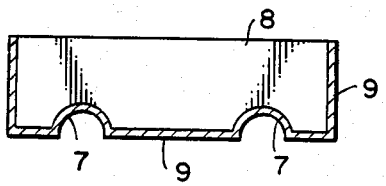
FIG. 3 is a side view of an insulating plate which provides coupling loops in accordance with the present invention.

FIG. 3 shows a side view of the coupling loops according to one embodiment of the present invention. An insulating plate 8 is provided with semicircular indentations 7 at one side, and the edge of the side is covered with a conduction layer 9. The insulating plate 8 is made, for example, of alumina or sapphire with a thickness of about 0.2 mm or more. The conduction layer 9 is formed of, for example, gold or copper by plating, sputtering or printing. The conduction layers thus provided operate as the coupling loops which magnetically couple with the YIG spheres. A suitable thickness of the conduction layers 9 is selected according to the frequency for which the filter is to be used, because of the skin effect.

Figure 4:
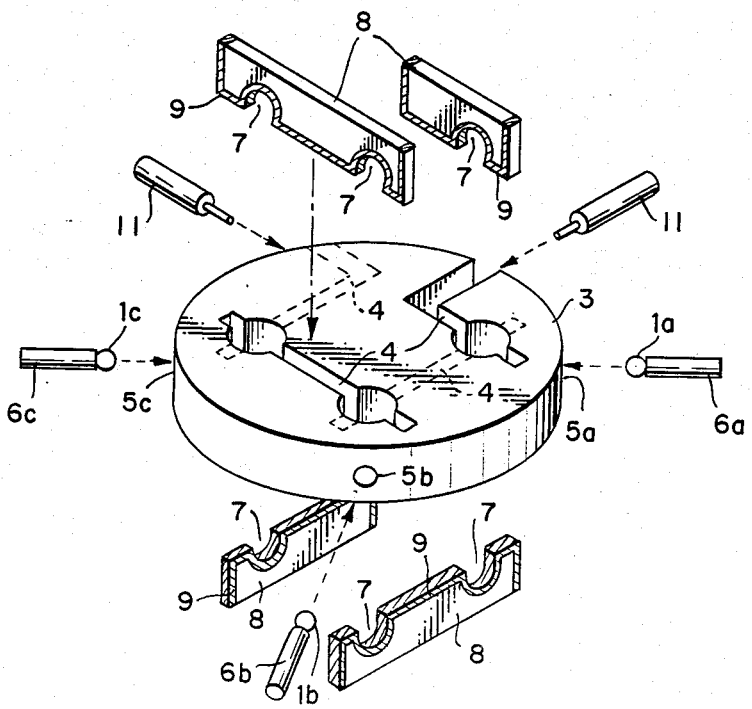
FIG. 4 is an exploded perspective view illustrating an embodiment of a YIG microwave band pass filter of the present invention.

FIG. 4 shows an exploded perspective view of an embodiment of the present invention. The insulating plates 8 thus constructed are inserted in the grooves (or slots) 4 formed in the housing 3 until the semicircular indentations 7 come to the position corresponding to the YIG spheres 1*a* to 1*c*.

The grooves 4 are provided both at the top and bottom of the housing 3 in this embodiment, and the coupling loops on the insulating plates 8 are disposed on both sides of the grooves 4, oriented so as to be mutually perpendicular at each YIG sphere. After reaching the predetermined position, the insulating plates are fixed to the housing 3 by soldering, for instance.

The YIG spheres 1*a*, 1*b*, 1*c* are mounted on the top of mounting rods 6*a*, 6*b*, 6*c* and inserted in the housing 3 through holes 5*a*, 5*b*, 5*c*, and at predetermined positions the mounting rods 6*a* to 6*c* are fixed to the housing 3. The mounting rods 6*a* to 6*c* are made, for example, of alumina or beryllia and work to hold the YIG spheres in place and also serve to equalize the temperatures between the housing 3 and the YIG spheres.

Coaxial cables 11 are installed in the housing 3 by soldering, for example, for input and output terminals. The outer conductors of the coaxial cables 11 are grounded to the housing 3 and the inner conductors of the coaxial cables 11 are connected to the conduction layers 9 on the respective insulating plates 8.

Figure 5:
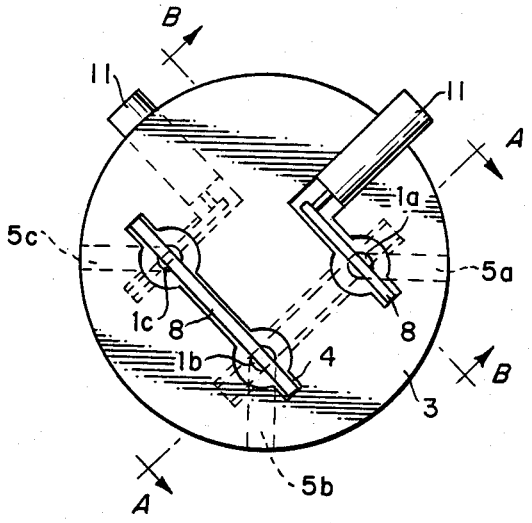
FIG. 5 is a top view of an embodiment of the present invention assembled in accordance with the procedure indicated in FIG. 4.

FIG. 5 is a top view of this embodiment of the present invention.

Figure 6:
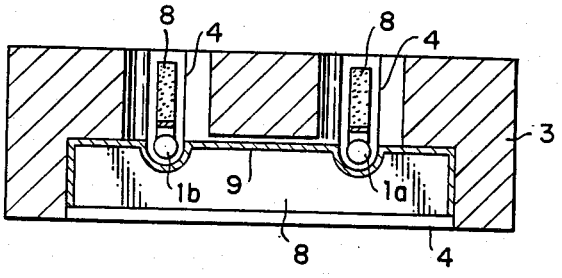
FIG. 6 is a cross sectional view taken along the line A—A in FIG. 5.

FIG. 6 is a cross sectional view taken along line A—A in FIG. 5. In FIG. 6 both ends of the conductive layer 9 on the insulating plate 8 are connected to the housing 3 for grounding.

Figure 7:
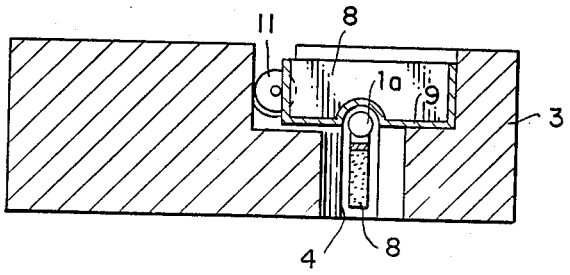
FIG. 7 is a cross sectional view taken along the line B—B in FIG. 5.

FIG. 7 is a cross sectional view taken along the line B—B in FIG. 5. In FIG. 7 one end of the conduction layer 9 is grounded and the other end is connected to the inner conductor of the coaxial cable 11.

Figure 8:
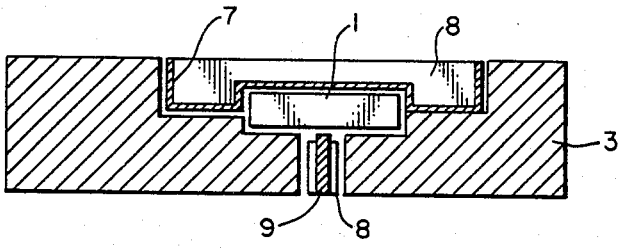
FIG. 8 shows a disc-shaped YIG element 1 within rectangular indentations in the insulating plates 8 having conduction layer 9.

In the present invention, a YIG element can also be formed in the shape of a flat disk with a rectangular cross section, in which case the corresponding indentations in the insulating plates may be essentially rectangularly shaped, as shown in FIG. 8. This combination of YIG element and corresponding indentations in the insulating plates, and other combinations of matching configurations between the YIG element and the indentations in the insulating plates, would be obvious to a skilled worker in the art, in light of the present disclosure.

We claim:

1. A YIG microwave band pass filter comprising a housing of non-magnetic material having holes formed therethrough between two faces of said housing, and slots on both said faces of said housing extending through respective ones of said holes, a respective insulating plate for fitting into each said slot, each said insulating plate having at least one indentation at one side edge thereof, and a conducting layer disposed along at least a part of said side edge and along each said indentation in each said insulating plate to provide a respective coupling loop along each said indentation, each said indentation corresponding to a respective one of said holes, a YIG element at a predetermined position in each said hole in said housing, said conducting layers of the respective insulating plates in said slots comprising mutually perpendicular ones of said coupling loops on opposite sides of each said YIG element, each said YIG element having a configuration matching with the respective indentations in the respective insulating plates, and means for attaching each said insulating plate at a respective predetermined position in the respective slot, wherein said filter has highly reproducible and stable characteristics as a result of said insulating plates being at respective predetermined positions with respect to said YIG elements.

2. The filter of claim 1, comprising:

a respective mounting rod for mounting each said YIG element on the end thereof, and said housing having additional holes for inserting each said YIG element on the respective mounting rod into a respective one of said holes.

3. The filter of claims 1 or 2, at least one of said YIG elements being a sphere and each corresponding one of said indentations in each respective one of said insulating plates having a semicircular shape in cross section.

4. The filter of claim 1 or 2, comprising a pair of further holes for receiving input and output coaxial cables, and said conducting layers on two of said insulating plates extending respectively on said side edges of said two insulating plates so as to respectively contact the inner conductor of said input and output coaxial cables.

5. The filter of claim 3, comprising said housing having a pair of further holes for receiving input and output coaxial cables, and said conducting layers on two of said insulating plates extending respectively on said side edges of said two insulating plates so as to respectively contact the inner conductors of said input and output coaxial cables.

6. The filter of claim 4, said housing comprising grounding means, and each said conducting layer on each said insulating plate extending to contact at least at one point of said grounding means of said housing.

7. The filter of claim 5, said housing comprising grounding means, and each said conducting layer on each said insulating plate extending to contact at least at one point of said grounding means of said housing.

8. The filter of claim 1 or 2, at least one of said YIG elements having a disk shape and each corresponding one of said indentations in respective ones of said insulating plates having an essentially rectangular shape corresponding to the respective cross section of the disk-shaped YIG element.

9. The filter of claim 8, comprising a pair of further holes for receiving input and output coaxial cables, and said conducting layers on two of said insulating plates extending respectively on said side edges of said two insulating plates so as to respectively contact the inner conductors of said input and output coaxial cables.

10. The filter of claim 9, said housing comprising grounding means, and each said conducting layer on each said insulating plate extending to contact at least at one point of said grounding means of said housing.

11. The filter of claim 6, said grounding means comprising conducting means at the bottom of said slots, wherein the surface of said slots have deeper portions apart from where said conducting layers contact said conducting means.

12. The filter of claim 7, said grounding means comprising conducting means at the bottom of said slots, wherein the surface of said slots have deeper portions apart from where said conducting layers contact said conducting means.

13. The filter of claim 10, said grounding means comprising conducting means at the bottom of said slots, wherein the surface of said slots have deeper portions apart from where said conducting layers contact said conducting means.

* * * * *

UNITED STATES PATENT AND TRADEMARK OFFICE

CERTIFICATE OF CORRECTION

PATENT NO. : 4,480,238

DATED : October 30, 1984

INVENTOR(S) : Jun-ichi Iwasaki

It is certified that error appears in the above-identified patent and that said Letters Patent is hereby corrected as shown below:

Front page, (56) References Cited, "Luderitz" should be --Lüderitz--.

Column 2, line 47, "layer" should be --layers--.

Signed and Sealed this

Thirtieth Day of April 1985

[SEAL]

*Attest:*

*Attesting Officer*

DONALD J. QUIGG

*Acting Commissioner of Patents and Trademarks*